US006048184A

United States Patent [19]

Chang et al.

[11] Patent Number: 6,048,184

[45] Date of Patent: Apr. 11, 2000

[54] BACK-PRESSURE SEALING SYSTEM FOR REVOLVING COMPRESSOR

[75] Inventors: Yu-Choung Chang, Taipei; Tse-Liang Hsiao, Hsinchu; Su Tao, KaoHsiung; Kun-I Liang, HengHsang; Chun-Chung Yang; Ann Huang, both of Hsinchu; Ching-Feng Lai, Taichung, all of Taiwan

[73] Assignee: Industrial Technology Research Institute, Hsinchu, Taiwan

[21] Appl. No.: 08/979,274

[22] Filed: Nov. 26, 1997

[51] Int. Cl.[7] ..... F01C 1/02

[52] U.S. Cl. ..... 418/55.5; 418/55.4; 418/57

[58] Field of Search ..... 418/55.4, 55.5, 418/57

[56] References Cited

U.S. PATENT DOCUMENTS 5,474,433 12/1995 Chang et al. ..... 418/55.5

*Primary Examiner*—Thomas Denion

*Assistant Examiner*—Theresa Trieu

*Attorney, Agent, or Firm*—W. Wayne Liauh

[57] ABSTRACT

A back-pressure sealing system for a revolving compressor, comprising: a stator with an outlet on the upper side and a neck, surrounding the outlet; a separating part above the stator, separating a low-pressure zone around the stator from a high-pressure zone above the outlet and having a central opening around the neck; a connecting system between the upper and lower sides of the separating part; a first sealing device for sealing the neck of the stator against the central opening of the separating part; and a second sealing device for sealing the connecting system; wherein the back-pressure from the high-pressure zone is used to tighten the first and second sealing devices for a good sealing effect and thus good effectiveness of the compressor.

8 Claims, 10 Drawing Sheets

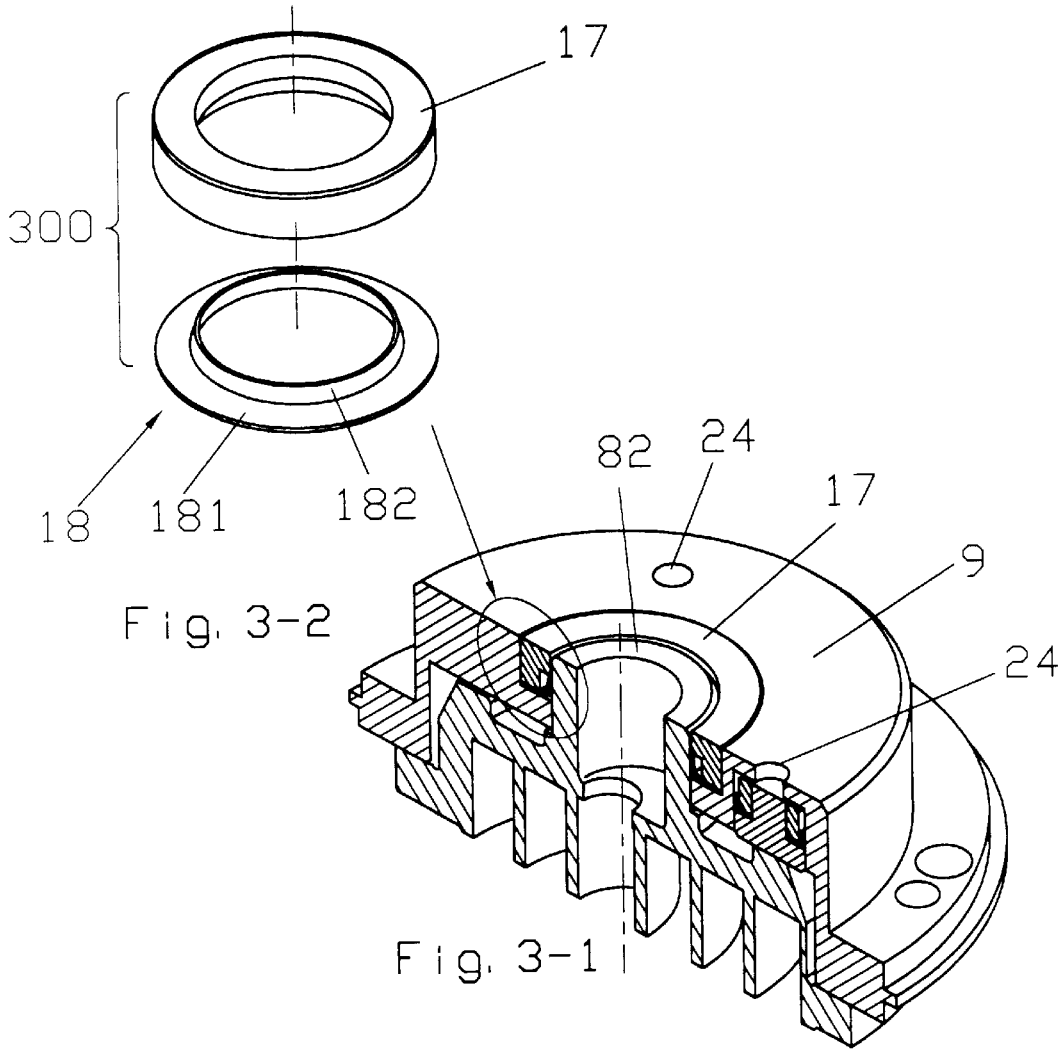
Fig. 3-2
Fig. 3-1
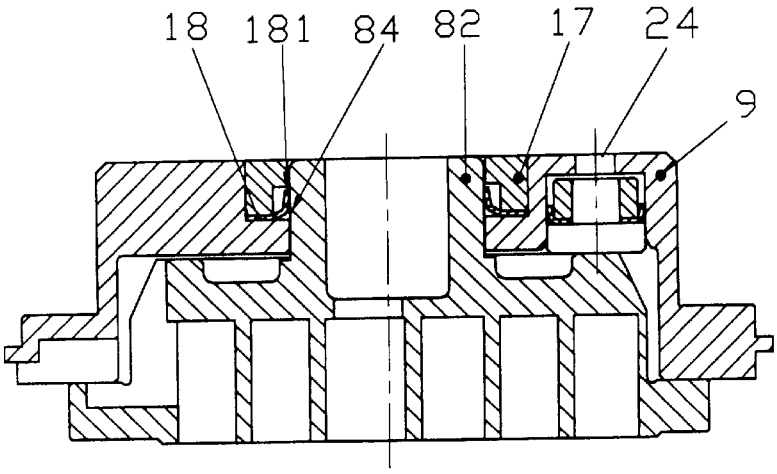
Fig. 3

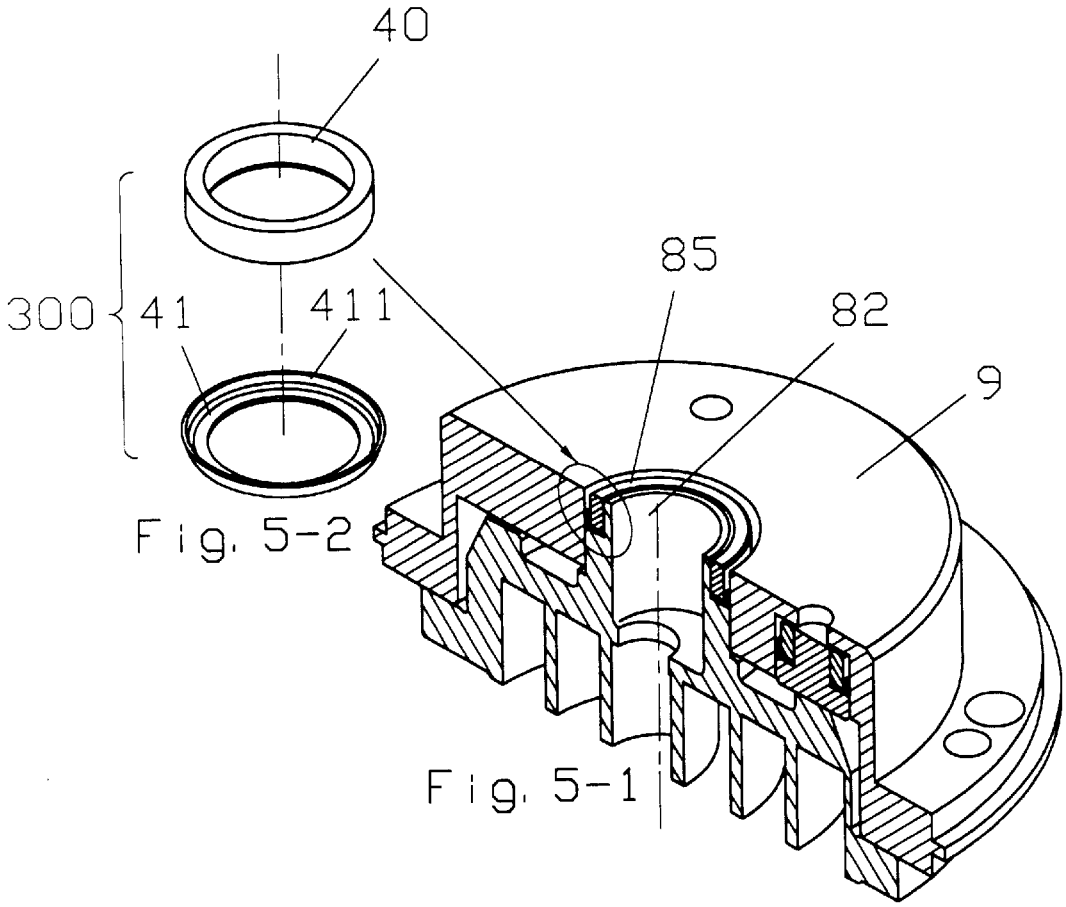
Fig. 5-2
Fig. 5-1
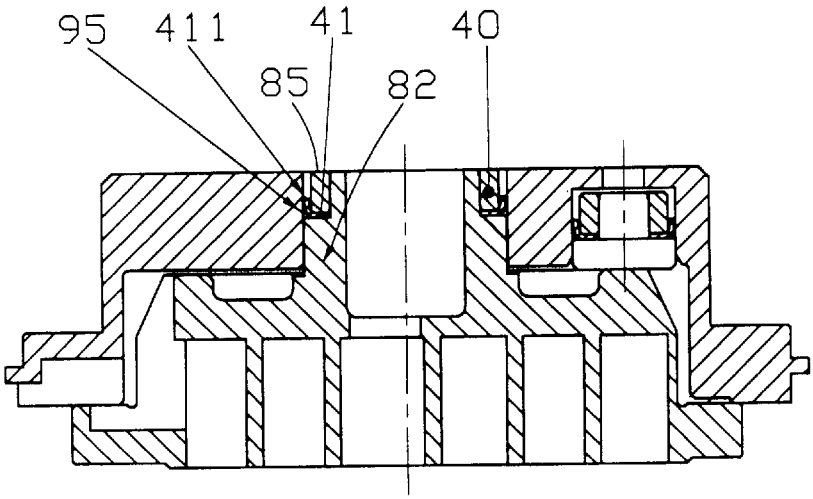
Fig. 5

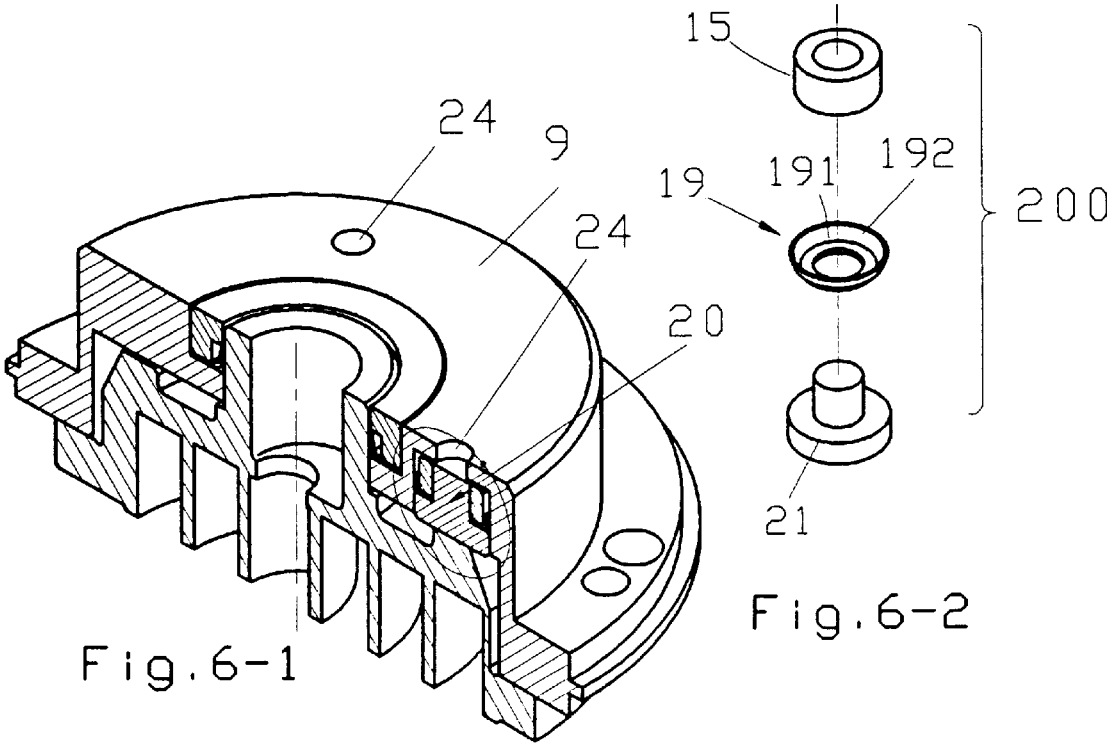
Fig.6-1
Fig.6-2
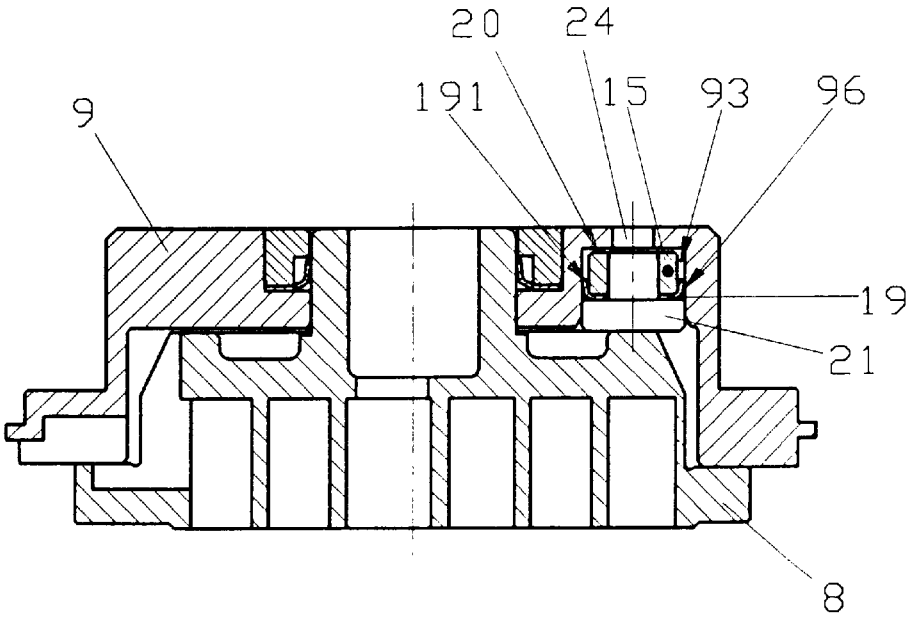
Fig.6

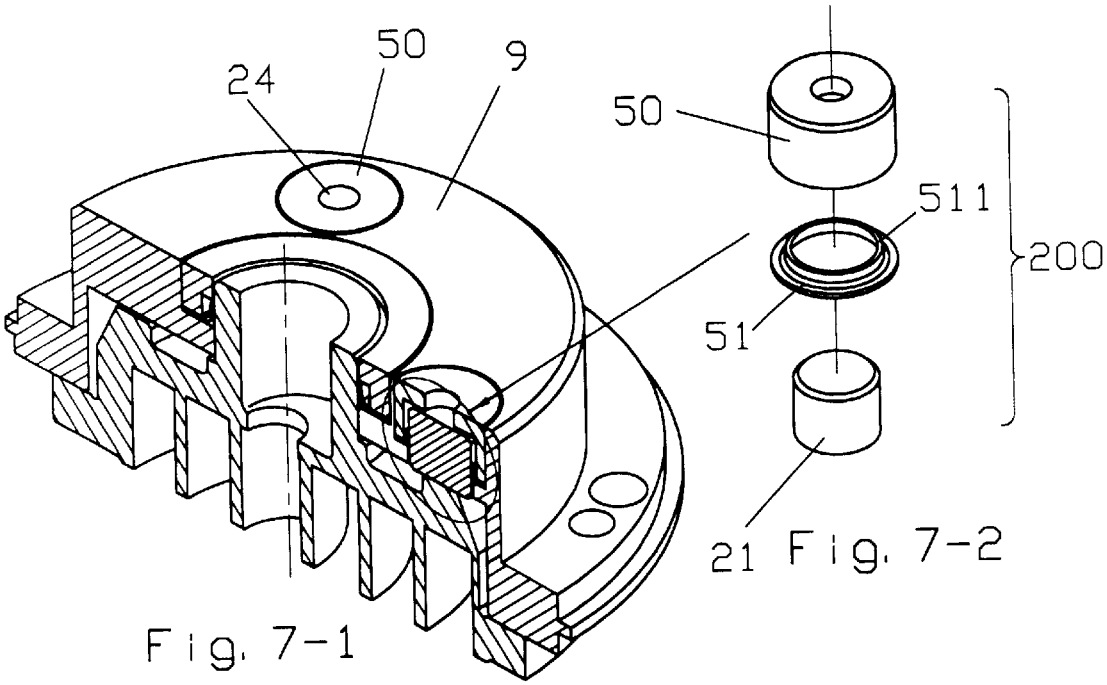
Fig. 7-1
Fig. 7-2
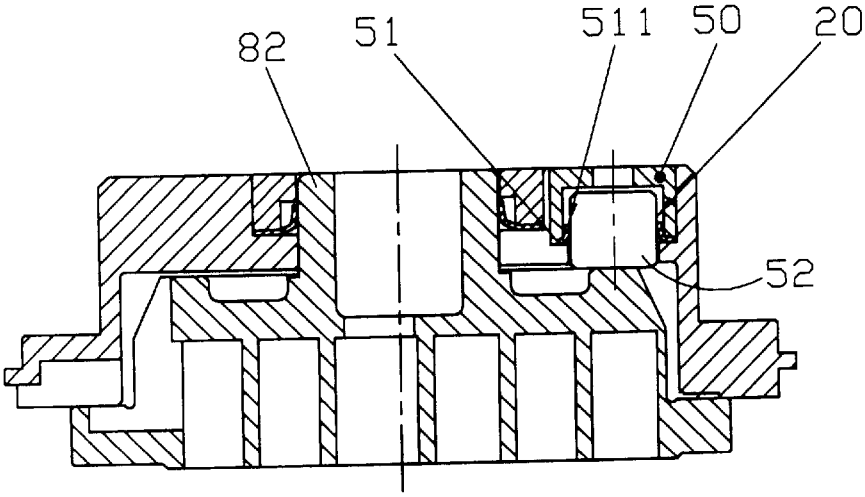
Fig. 7

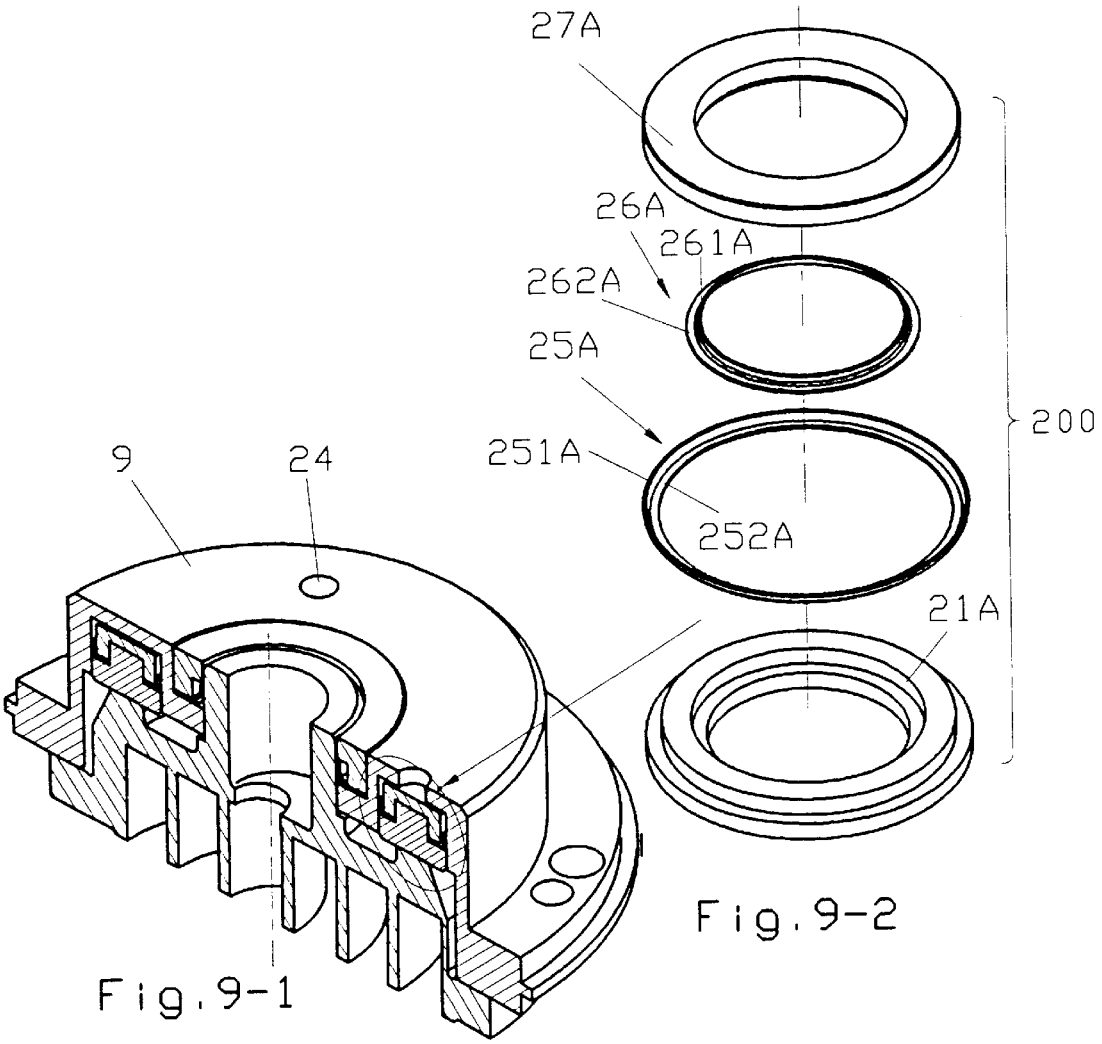
Fig.9-1
Fig.9-2
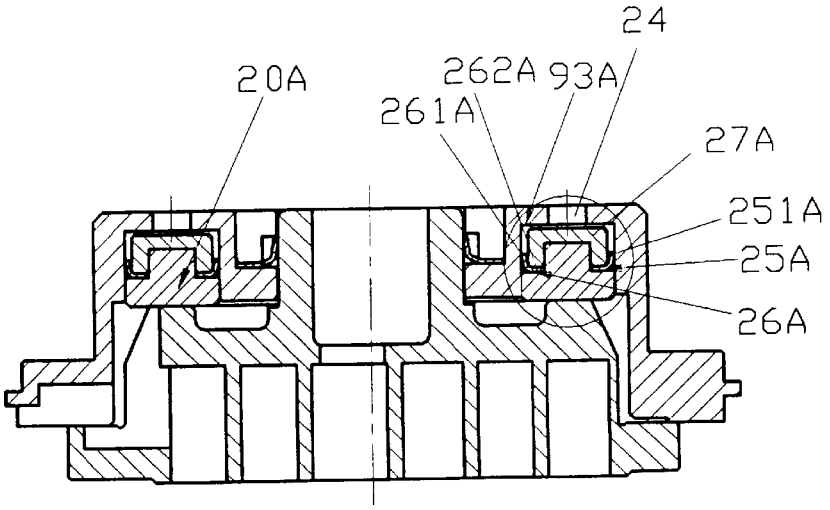
Fig.9

BACK-PRESSURE SEALING SYSTEM FOR REVOLVING COMPRESSOR

BACKGROUND OF THE INVENTION

1. Field of the Invention

The present invention relates to a back-pressure sealing system for a revolving compressor, particularly to a back-pressure sealing system of simple structure, high durability and stability, allowing for high pressures.

2. Description of Related Art

Air conditioners and refrigerators use compressors as central devices, which are expected to exchange heat effectively, with little noise and for a long lifetime. Good quality of compressors contributes to energy-saving. Compressors are expensive devices, to replace or repair them results in material and work costs, and to exchange the refrigerant is costly and harms the environment. Therefore improving compressors is an important task.

FIG. 2 is a schematic illustration of a conventional rubber back-pressure sealing system in a revolving compressor. A revolving compressor basically has a motor 5, driving an eccentric shaft 4, which in turn drives a rotor 6. An Oldham ring 7 allows the rotor 6 to revolve around the axis of rotation of the motor 5, engaging with a stator 8, and at the same time prevents the rotor 6 from rotating around its own axis. The movement of the rotor 6 causes a liquid agent to be let into the space between the rotor 6 and the stator 8, compressed there and let out from there. For good operation, the stator 8 has to be sealed effectively on the axis of the revolving movement of the rotor 6. Any leakage from the outlet chamber would let the rotor 6 revolve non-uniformly and thus cause noise and wear.

Taiwan patent no. 107089 and U.S. Pat. No. 5474433 disclose a sealing system. As shown in FIG. 2, a conventional back-pressure sealing system is characterized by the following: (1) A rubber sealing ring (O-ring) 1A of appropriate size is laid into a peripheral groove 821 on the stator 8, sealing the stator 8 against an inner wall 95 of a separating part 9. Thereby a high-pressure zone 14 is separated from a low-pressure zone 12. (2) Rubber sealing rings 1B of appropriate sizes are laid into grooves in accommodation chambers 93 of a connecting system to the high-pressure zone, for preventing leakage through the separating part 9.

When the sealing system described above is installed under no high pressure and temperature, the sealing effect is good. However, the location of the sealing system is normally exposed to liquid of high pressure and temperature, and the structural elements there start to glide against each other along the revolving axis. After prolonged use the sealing rings swell and become soft. Vibrations of the structural elements next to the sealing ring cause wear and corrosion of the sealing ring, such that the liquid agent leaks through.

SUMMARY OF THE INVENTION

An object of the present invention is to provide a back-pressure sealing system for a revolving compressor which is resistant against heat and corrosion, of high durability and low friction and which with appropriate form and size is installed between the neck of the stator and the outlet chamber, wherein the pressure difference between the high-pressure zone and the low-pressure zone causes the sealing rings to tighten, such that effective sealing is achieved.

Another object of the present invention is to provide a back-pressure sealing system for a revolving compressor which with a prolonged sealing effect ensures an effective operation of the compressor for the benefit of economy and the environment.

A further object of the present invention is to provide a back-pressure sealing system for a revolving compressor which operates smoothly without much noise.

The present invention can be more fully understood by reference to the following description and accompanying drawings.

BRIEF DESCRIPTION OF THE DRAWINGS

FIG. 3 is a sectional view of the first sealing device on the neck of the stator in the first embodiment.

FIG. 3-1 is a perspective view of the first sealing device on the neck of the stator in the first embodiment.

FIG. 3-2 is an exploded view of the first sealing device in the first embodiment.

FIG. 4-1 is a perspective view of the first sealing device on the neck of the stator in the second embodiment.

FIG. 4-2 is an exploded view of the first sealing device in the second embodiment.

FIG. 5 is a sectional view of the first sealing device on the neck of the stator in the third embodiment.

FIG. 5-1 is a perspective view of the first sealing device on the neck of the stator in the third embodiment.

FIG. 5-2 is an exploded view of the first sealing device in the third embodiment.

FIG. 6 is a sectional view of the second sealing device on the outlet to the outlet chamber in the first embodiment.

FIG. 6-1 is a perspective view of the second sealing device on the outlet to the outlet chamber in the first embodiment.

FIG. 6-2 is an exploded view of the second sealing device in the first embodiment.

FIG. 7 is a sectional view of the second sealing device on the outlet to the outlet chamber in the second embodiment.

FIG. 7-1 is a perspective view of the second sealing device on the outlet to the outlet chamber in the second embodiment.

FIG. 7-2 is an exploded view of the second sealing device in the second embodiment.

FIG. 8-1 is a perspective view of the second sealing device on the outlet to the outlet chamber in the third embodiment.

FIG. 8-2 is an exploded view of the second sealing device in the third embodiment.

FIG. 9 is a sectional view of the second sealing device on the outlet to the outlet chamber in the fourth embodiment.

FIG. 9-1 is a perspective view of the second sealing device on the outlet to the outlet chamber in the fourth embodiment.

FIG. 9-2 is an exploded view of the second sealing device in the fourth embodiment.

FIG. 10-1 is a perspective view of the second sealing device on the outlet to the outlet chamber in the fifth embodiment.

FIG. 10-2 is an exploded view of the second sealing device in the fifth embodiment.

DETAILED DESCRIPTION OF THE PREFERRED EMBODIMENTS

Figure 1:
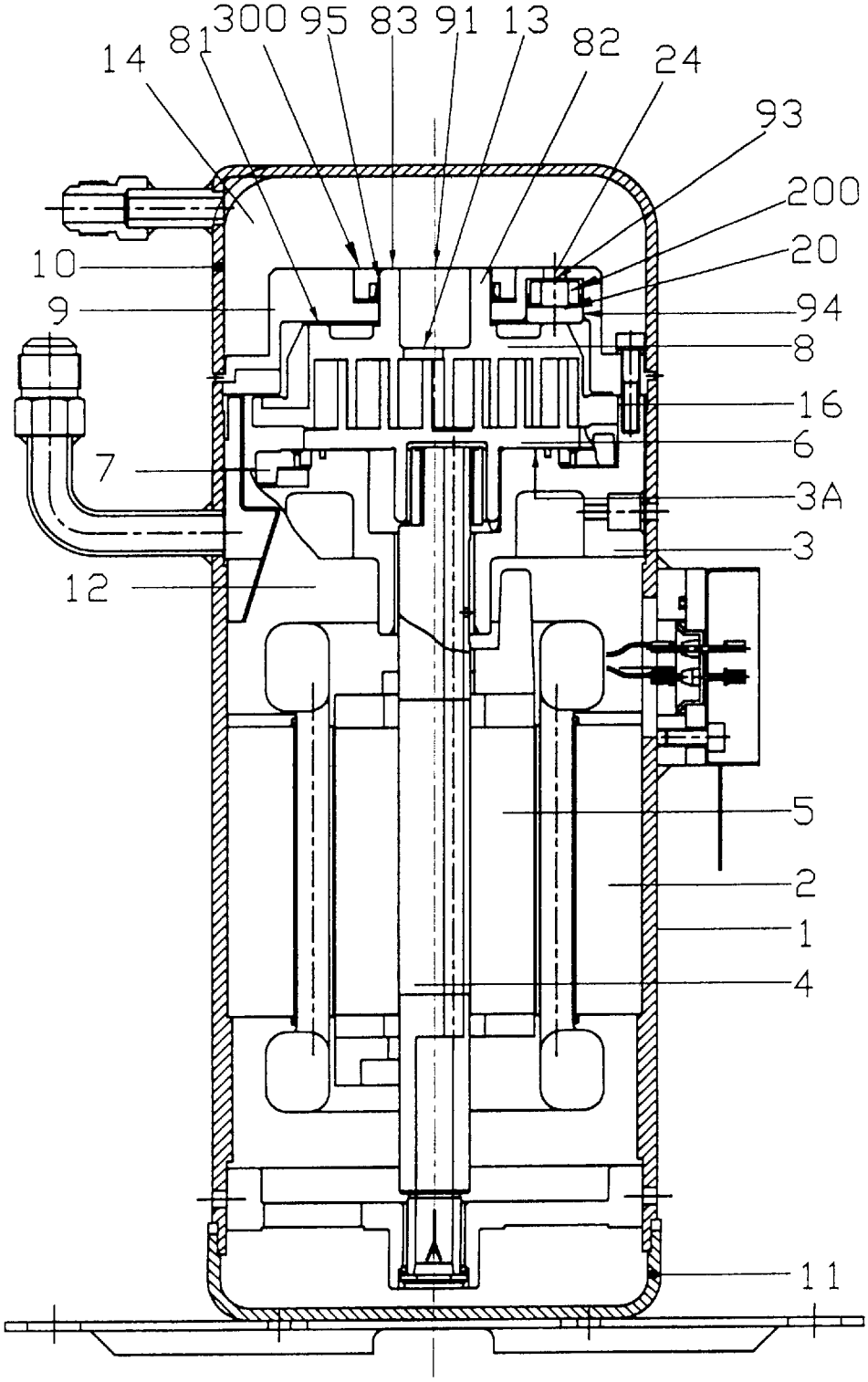
FIG. 1 is a schematic illustration of the back-pressure sealing device for a revolving compressor of the present invention.

As shown in FIG. 1, the back-pressure sealing system of the present invention is installed in a revolving compressor, which mainly comprises: a vertical, cylindrical casing 1; a motor holder 2, mounted on the inside of the casing 1; a frame 3 on the motor holder 2, welded to the inner side the casing 1 and having an upper side 3A; a vertical eccentric shaft 4; a motor 5, driving the eccentric shaft 4; a rotor 6, driven by the eccentric shaft 4 in a revolving movement around a central vertical axis; an Oldham ring 7 for restricting the rotor 6 to a fixed orientation in the revolving movement thereof; a stator 8, engaging with the rotor 6; a separating part 9 on the upper side of the stator 8, welded to the inner side the casing 1; a lid 10, tightly closing the upper side of the casing 1; and a bottom 11, tightly closing the lower side of the casing 1.

Below the separating part 9, the inside of the casing 1 is a low-pressure zone 12. Refrigerant enters the low-pressure zone 12 through an inlet tube. By the revolving movement of the rotor 6, the refrigerant is sucked into the space between the rotor 6 and stator 8, compressed and let out through an outlet 13 into an outlet chamber above the separating part 9. The outlet chamber is a high-pressure zone 14 within the casing 1. An outlet tube allows refrigerant to leave the high-pressure zone 14.

The separating part 9 has a central opening 91, which is concentric with the central vertical axis, with an inner wall 95, and several connecting system 20. The connecting system 20 comprises several accommodation chambers 93, which are open towards the stator 8 below and has a peripheral inner wall 96 and a peripheral base 933, a plug 21, inserted into the accommodation chamber 93 from below, and a top hole 24 on the upper side of the accommodation chamber 93.

The stator 8 has on its upper side a central neck 82, which in turn has an upper side 83 and a peripheral wall 84, and a circular protrusion 81, which leans against the separating part 9. The relatively high pressure in the high-pressure zone 14 presses the separating part 9 on the circular protrusion 81 and also presses on the upper side 83 of the neck 82, such that the stator 8 in turn presses the rotor 6 on the upper side 3A of the frame 3, preventing vibrations of the rotor 6. A first sealing device 300 is located in a peripheral opening between the neck 82 of the stator 8 and the separating part 9 around the central opening 91 thereof. For each accommodation chamber 93, several second sealing devices 200 are laid around the plug 21. Thus the high-pressure zone 14 and the low-pressure zone 12 are sealed from each other.

Figure 2:
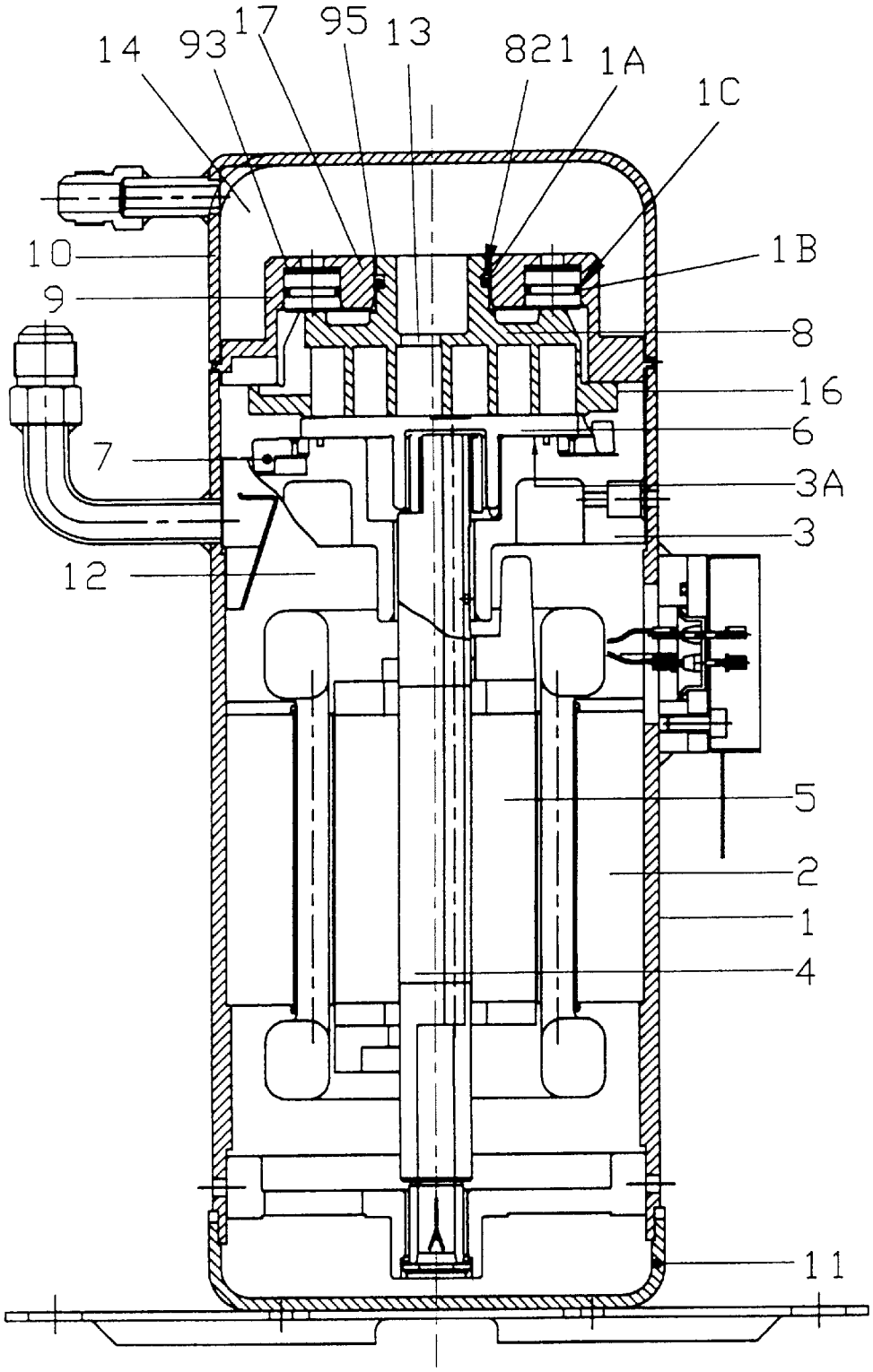
FIG. 2 is a schematic illustration of a conventional back-pressure sealing device for a revolving compressor.

Referring to FIGS. 3–3-2, in a first embodiment the first sealing device 300 is comprises a first sealing ring 18, which has a flat part 181 and an upward bent inner periphery 182, and a first cap ring 17 for holding the first sealing ring 18 and pressing thereon to improve the sealing effect.

Referring to FIGS. 6–6-2, in a first embodiment each of the second sealing devices 200 is located in one of the accommodation chambers 93 of the connecting system 20. Each of the second sealing devices 200 comprises a second sealing ring 19, which has a flat part 191 and an upward bent outer periphery 192, and a second cap ring 15 for holding the second sealing ring 19. High pressure in the high-pressure zone presses the outer periphery 192 against the peripheral inner wall 96 of the accommodation chamber 93 and improves the sealing effect.

Figures 2, 4:
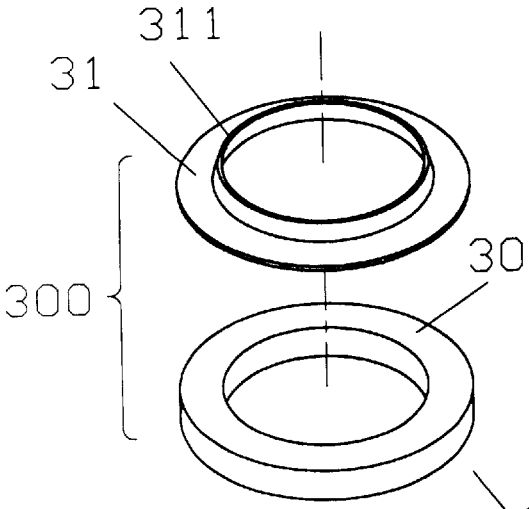
FIG. 4 is a sectional view of the first sealing device on the neck of the stator in the second embodiment.
Figures 1, 4:
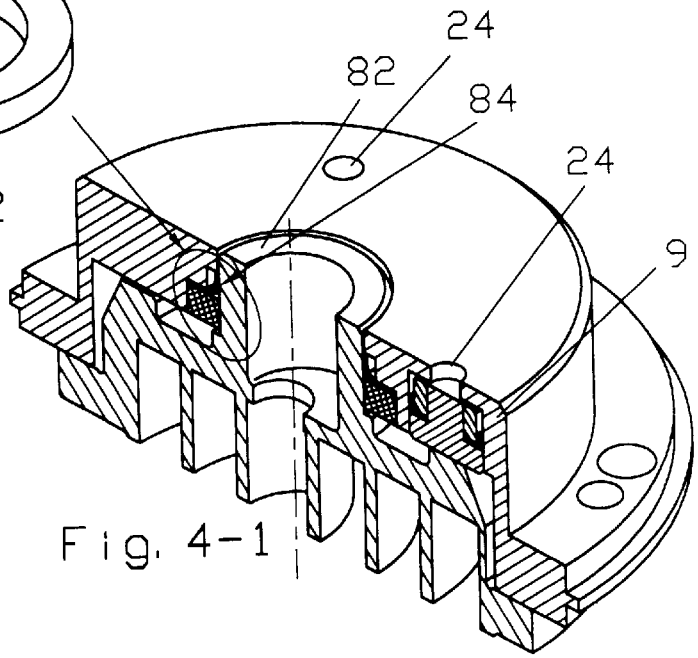
Figure 4:
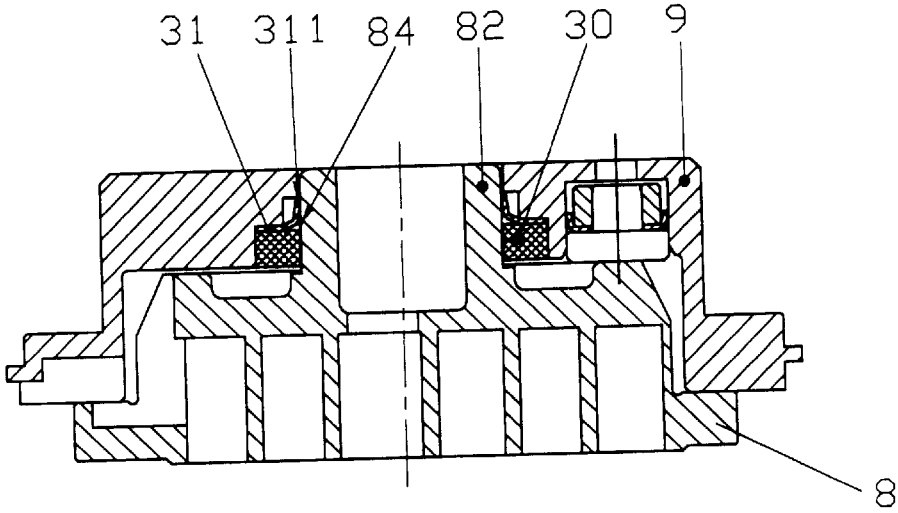

The first sealing device 300 of the present invention has further embodiments. Referring to FIGS. 4–4-2, in a second embodiment the first sealing device 300 comprises a first sealing ring 31, which has an upward bent inner periphery 311, surrounding the neck 82 of the stator 8, and a first base ring 30 for supporting the first sealing ring 31. With high pressure from the high-pressure zone, the first sealing ring 31 is pressed against the peripheral wall 84 of the neck 82, so as to improve the sealing effect.

Referring to FIGS. 5–5-2, in a third embodiment the first sealing device 300 comprises a first sealing ring 41, which has an upward bent outer periphery 411, leaning against the inner wall 95 of the central opening 91, and a first cap ring 40 for holding the first sealing ring 41. With high pressure from the high-pressure zone, the first sealing ring 41 is pressed against the inner wall 95 of the central opening 91, so as to improve the sealing effect.

The second sealing device 200 of the present invention has further embodiments, too. Referring to FIGS. 7–7-2, in a second embodiment each of the second sealing devices 200 comprises a second sealing ring 51, which has an upward bent inner periphery 511, and a second cap ring 50 for holding the second sealing ring 51. High pressure in the high-pressure zone presses the inner periphery 511 against the plug 21, so as to improve the sealing effect.

Figures 1, 8:
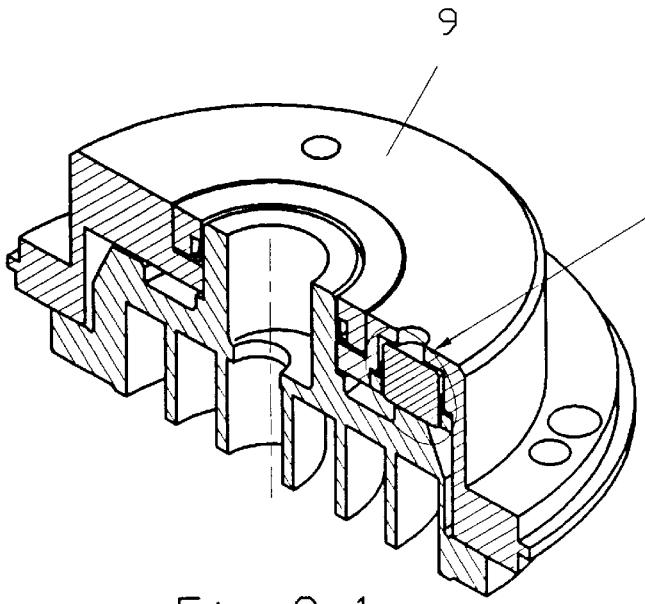
FIG. 8 is a sectional view of the second sealing device on the outlet to the outlet chamber in the third embodiment.
Figures 2, 8:
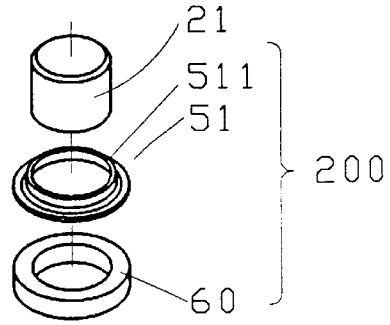
Figure 8:
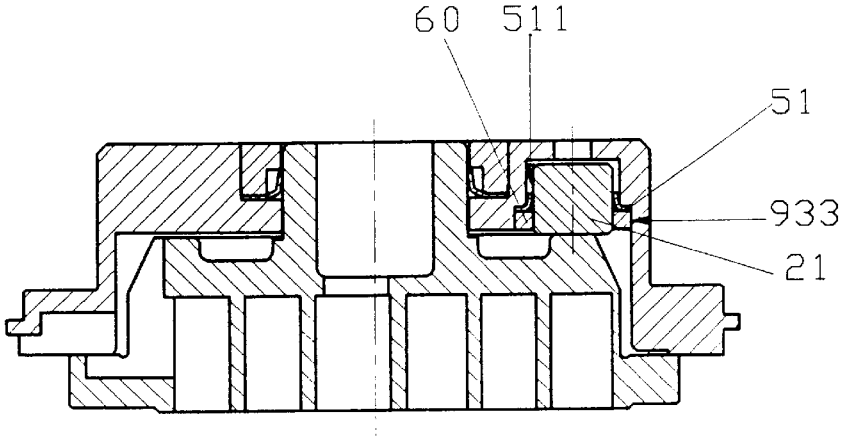

Referring to FIGS. 8–8-2, in a third embodiment each of the second sealing devices 200 comprises a second sealing ring 51, which has an upward bent inner periphery 511, and a second base ring 60, leaning on the peripheral base 933 of the accommodation chamber 93 for supporting the second sealing ring 51. High pressure in the high-pressure zone presses the inner periphery 511 against the plug 21, so as to improve the sealing effect.

Referring to FIGS. 9–9-2, in a fourth embodiment the present invention has a connecting system 20A between the high-pressure zone 14 and the low-pressure zone 12 with a single ring-like accommodation groove 93A. The accommodation groove 93A concentrically surrounds the neck 82 of the stator 8, opening towards the low-pressure zone 12. A ring-shaped plug 21A is inserted into the accommodation groove 93A from the low-pressure zone 12. A second sealing device 200 seals the low-pressure zone 12 from the high-pressure zone 14. The second sealing device 200 concentrically surrounds the neck 82 of the stator 8, comprising an inner sealing ring 26A, which has a flat part 262A and an upward bent inner periphery 261A, an outer sealing ring 25A, which has a flat part 252A and an upward bent outer periphery 251A, and a second cap ring 27A for holding the inner and outer sealing rings 26A and 25A. High pressure in the high-pressure zone 14 presses the inner periphery 261A and the outer periphery 251A against the peripheral walls of the accommodation groove 93A, so as to improve the sealing effect.

Figures 1, 10:
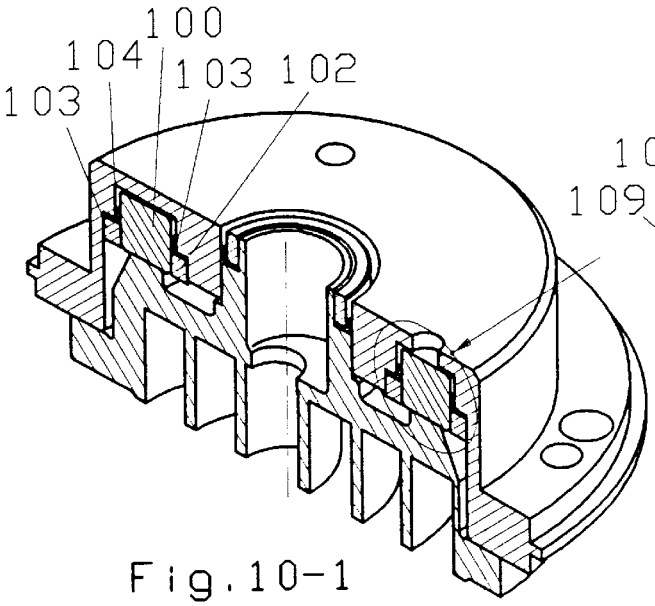
FIG. 10 is a sectional view of the second sealing device on the outlet to the outlet chamber in the fifth embodiment.
Figures 2, 10:
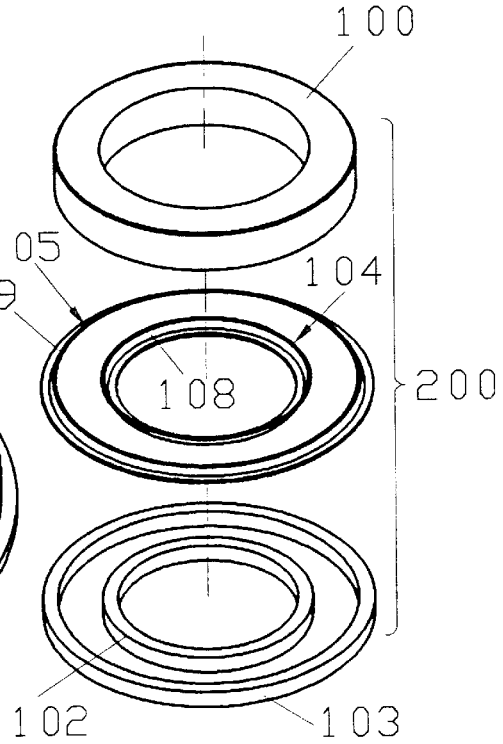
Figure 10:
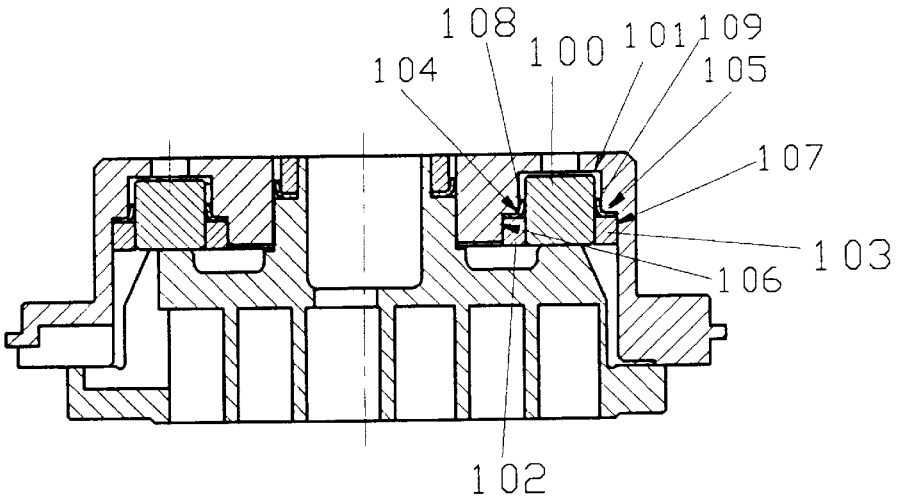

Referring to FIGS. 10–10-2, in a fifth embodiment the present invention has a connecting system between the high-pressure zone 14 and the low-pressure zone 12, with a single accommodation groove 101 concentrically surrounding the neck 82 of the stator 8 and on the lower side broadening inward to an inner base 106 and outward to an outer base 107. A ring-shaped plug 100 is inserted therein from the low-pressure zone 12. A second sealing device 200 seals the low-pressure zone 12 from the high-pressure zone 14. The second sealing device 200 concentrically surrounds the neck 82 of the stator 8, comprising an inner sealing ring 104, which has an upward bent outer periphery 108, an outer sealing ring 105, which has an upward bent inner periphery 109, an inner base ring 102, accommodated in the inner base 106 and supporting the inner sealing ring 104, and an outer base ring 103, accommodated in the outer base 107 and supporting the outer sealing ring 105. High pressure in the high-pressure zone 14 presses the outer periphery 108 and the inner periphery 109 against the peripheral walls of the accommodation groove 101, so as to improve the sealing effect.

We claim:

1. A back-pressure sealing system for a revolving compressor, comprising:

a stator with an upper side, blades in several circles around a vertical axis and an outlet on said upper side, which is concentric with said vertical axis and has a peripheral wall, which forms an upward protruding neck with an outer wall;

a separating part above said stator with an upper side and a lower side, having a central opening with an inner wall, which is concentric with said vertical axis, surrounding said neck of said stator;

a connecting system, connecting said upper and lower sides of said separating part and having an accommodating system, which is open to said lower side of said separating part, from where a closing element with a lateral surface is inserted, and which has an lateral wall and top holes, which connect to said upper side of said separating part;

a first sealing device between said neck of said stator and said central opening of said separating part, said first sealing device further comprising a first sealing ring with an upward bent periphery, which leans against said outer wall of said neck of said stator or against said inner wall of said central opening, and a first holding ring for holding said first sealing ring;

a second sealing device, located in said accommodating system between said lateral surface of said closing element and said lateral wall and further comprising at least one second sealing ring with an upward bent periphery, which leans against at least one of said lateral surface of said closing element and said lateral wall of said accommodating system, and a second holding ring for holding said at least one second sealing ring.

2. A back-pressure sealing system according to claim 1, wherein said first holding ring of said first sealing device is fixed to said separating part and said periphery of said first sealing ring leans against said outer wall of said neck of said stator.

3. A back-pressure sealing system according to claim 1, wherein said first holding ring of said first sealing device is fixed to said neck of said stator and said periphery of said first sealing ring leans against said inner wall of said central opening of said separating part.

4. A back-pressure sealing system according to claim 1, wherein said closing system comprises several plugs around said central opening of said separating part.

5. A back-pressure sealing system according to claim 4, wherein said second holding ring is fixed to said closing system and said periphery of said at least one second sealing ring leans against said lateral wall of accommodating system.

6. A back-pressure sealing system according to claim 4, wherein said second holding ring is fixed to said accommodating system and said periphery of said at least one second sealing ring leans against lateral surface of said closing system.

7. A back-pressure sealing system according to claim 1, wherein said closing system is a ring-shaped plug with an inner wall and an outer wall around said central opening of said separating part.

8. A back-pressure sealing system according to claim 7, wherein said second sealing device comprises:

an inner sealing ring on said inner surface of said plug;

an outer sealing ring on said outer surface of said plug;

an inner holding ring for holding said inner sealing ring; and an outer holding ring for holding said outer sealing ring.

* * * * *